US008578830B2

(12) United States Patent
McCahon et al.

(10) Patent No.: US 8,578,830 B2
(45) Date of Patent: Nov. 12, 2013

(54) SYSTEMS AND METHOD FOR IGNITING EXPLOSIVES

(75) Inventors: Stephen McCahon, Tucson, AZ (US); Paul B. Lundquist, Vail, AZ (US); Richard J Adler, Marana, AZ (US); Joseph C. Hayden, Tucson, AZ (US); Eric Lau, Tucson, AZ (US)

(73) Assignee: Applied Energetics, Inc., Tucson, AZ (US)

( * ) Notice: Subject to any disclaimer, the term of this patent is extended or adjusted under 35 U.S.C. 154(b) by 0 days.

(21) Appl. No.: 13/177,871

(22) Filed: Jul. 7, 2011

(65) Prior Publication Data

US 2011/0259181 A1 Oct. 27, 2011

Related U.S. Application Data

(63) Continuation of application No. 11/126,509, filed on May 9, 2005, now Pat. No. 7,987,760.

(60) Provisional application No. 60/678,240, filed on May 3, 2005.

(51) Int. Cl.
*F41H 11/136* (2011.01)

(52) U.S. Cl.
USPC ..... 89/1.13; 102/403

(58) Field of Classification Search
USPC ..... 89/1.13; 102/402, 403
See application file for complete search history.

(56) References Cited

U.S. PATENT DOCUMENTS

| | | | | |
|---|---|---|---|---|
| 676,583 | A | 6/1901 | Kinralde | |
| 1,999,414 | A * | 4/1935 | King | 361/219 |
| 2,549,533 | A | 4/1951 | Sevold | |
| 4,021,725 | A * | 5/1977 | Kirkland | 324/326 |
| 4,321,653 | A * | 3/1982 | Takahashi | 361/219 |
| 4,380,958 | A | 4/1983 | Betts | |
| 4,967,048 | A | 10/1990 | Langston | |
| 5,668,342 | A | 9/1997 | Dishcher | |
| 5,856,629 | A | 1/1999 | Grosch | |
| 5,982,180 | A | 11/1999 | Bushman | |
| 7,296,503 | B1 * | 11/2007 | McGrath | 89/1.13 |

(Continued)

FOREIGN PATENT DOCUMENTS

| | | | |
|---|---|---|---|
| DE | 34 44 037 | A1 * | 6/1986 |
| DE | 35 26 492 | A1 * | 1/1987 |

OTHER PUBLICATIONS http://crohmiq.com/mie-fibc-minimum-ignition-energy-antistatic-big-bags.html CROHMIQ Static FIBC Fabrics, 3 pages.

(Continued)

*Primary Examiner* — Stephen M Johnson
(74) *Attorney, Agent, or Firm* — Duft Bornsen & Fettig, LLP; Gregory T. Fettig

(57) ABSTRACT

Systems and methods are presented herein that provide for ignition of explosive devices through electric and/or electromagnetic discharge. In one embodiment, an electrostatic discharge is directionally propagated through air to conduct electric current to the explosive device. The electric current may ignite the explosive device via heat, via triggering of ignition circuitry, via induced electric current conduction to the explosive material therein and/or via direct electric conduction to the explosive material therein. Alternatively, or in addition to, electromagnetic energy may be directionally propagated to the device through a waveguide. Such electromagnetic energy may be in the microwave region and may heat and/or induce electric current in the explosive device. In either instance, the directionally propagated energy may be time varying. In one embodiment, a system is configured with a vehicle to distally position the directionally propagated energy to the explosive device such that damage caused by the device is inhibited.

11 Claims, 8 Drawing Sheets

(56) References Cited

U.S. PATENT DOCUMENTS

| | | | | |
|---|---|---|---|---|
| 7,770,506 | B2 * | 8/2010 | Johnson et al. | 89/36.09 |
| 7,987,760 | B1 * | 8/2011 | Lundquist et al. | 89/1.13 |
| 2012/0210854 | A1 * | 8/2012 | Bitar et al. | 89/1.13 |

OTHER PUBLICATIONS http://www.teledynerisi.com/products/Oproducts_8td_pageO2.asp Teledyne RISI Inc., 1 page.

Terry R. Gibbs, John F. Baytos, LASL Explosive Property Data University of California Press (1980) pp. 460-461 available at Google books, 4 pages.

Graham L. Hearn, Static Electricity, Guidance for Plant Engineers, Internet Article (2002) available at http://www.wolfsonelectrostatics.com/01_hazards/pdfs/guidanceforplantengineer s-staticelectricity.pdf, 9 pages.

Heinz Haase, "Electrostatic Hazards, their Evaluation and Control," Verlag Chemie, Weinheim NY 1977, 10 pages.

* cited by examiner

SYSTEMS AND METHOD FOR IGNITING EXPLOSIVES

CROSS-REFERENCE TO RELATED APPLICATIONS

This application is a continuation patent application claiming priority to and thus the benefit of an earlier filing date from U.S. patent application Ser. No. 11/126,509 (filed May 9, 2005), now U.S. Pat. No. 7,987,760 which claims priority to and thus the benefit of an earlier filing date from U.S. Provisional Patent Application No. 60/678,240 (filed May 3, 2005), the entire contents of each of which are hereby incorporated by reference.

BACKGROUND OF THE INVENTION

1. Field of the Invention

The invention generally relates to the ignition of explosive devices. More particularly, the invention relates to igniting explosive devices from a defensive perspective (e.g., to explode land mines, improvised explosive devices, roadside bombs, etc.).

2. Description of the Related Art

Attacks by opposing forces (e.g., military enemies, terrorists and/or militant groups) exist in a variety of forms. Such attacks often include more covert aggression in the form of entrapment devices, or booby-traps, such as landmines and IEDs. These entrapment devices are exceptionally hazardous and often result in lost lives of peacekeeping forces and damage to vehicles and other equipment. Moreover, the groups of people using such devices are typically unorganized and rely on unconventional methods of attack. When these devices are not used, they are often forgotten about and remain as a hazard to a non-combatant.

Landmines can be pressure sensitive devices that ignite based on the depression of a triggering mechanism. Such explosive devices may be ignited simply by means of dragging weighted objects across the ground where a landmines lies. For example, during the Vietnam War, helicopters would drag heavy and large metal platforms across the ground to ignite such devices. While this method may still be useful in igniting such devices, it is substantially ineffective at igniting electronically triggered explosive devices, such as IEDs because such devices are not typically designed to ignite upon physical force. Other means for igniting explosive devices exist such as that illustrated at http://www.eschel.co.il/dui/products/s/souvim.htm

SUMMARY OF THE INVENTION

The invention generally relates to systems and methods for igniting or disabling explosives. More particularly, the invention relates to igniting or disabling explosive devices, such as landmines and Improvised Explosive Devices ("IED"; e.g., "roadside bombs"). In one embodiment of the invention, a strong electric field is generated to cause electric current flow to an explosive device. The electric current is used to thereby ignite explosive material therein (e.g., those materials listed at http://www.globalsecurity.org/mititary/systems/munitions/explosives-uno.htm and http://www.atf.gov/pub/fire-explo_pub/listofexp.htm) and/or disable the detonating electronics while personnel and/or equipment are at a safe "standoff" distance. For example, IEDs are often placed underground or roadside by terrorists and are connected to some sort of triggering mechanism (e.g., a switch in communication with a cellular telephone, or wires connected to a remote switch). The triggering mechanism may be used by terrorists to ignite the IED when, for example, a terrorist's target passes by. Ignition of the IED is intended to confuse, disable and/or destroy the terrorist's target. Ignition or disabling of the IED, with the techniques of the present invention, prior to its intended ignition by the terrorist may substantially reduce the effectiveness of such explosive devices. In one embodiment of the invention, electrical energy is transmitted (e.g., capacitively, inductively, and/or through direct discharges) proximate to the explosive device or wires connected thereto from a distally positioned probe to ignite the device. For example, electrical energy may be directly discharged from an electrode to the explosive device. The electrical energy may directly ignite the explosive device through heating and/or indirectly trigger the device by means of electrical propagation through the device's circuitry. The probe, therefore, may provide a safer "standoff" distance. Additionally, the probe may be configured from expendable components such that it may be sacrificed if the explosive is ignited.

In one embodiment of the invention, a relatively strong electric field is generated in the vicinity of the explosive device in order to induce electric current that may heat the device. For example, the strong electric field may be such that an induced electric current flows within components of the explosive device (e.g., wires, metal housing and/or the explosive material itself). Additionally, a strong electric field passing in the vicinity of the explosive device may cause electric current to "arc" about metallic edges of the housing and/or current to flow within wires of the device. This electric current may subsequently flow through the trigger, bridgewire, and/or the explosive material of the device to ignite the explosive material. Those skilled in the art are readily familiar with such components. Alternatively, the electric current may damage and/or disable electrical components required to trigger the explosive device (e.g., a discharge across an open switch can close the triggering circuit thereby disabling it). For example, the electrical energy discharge may damage receiver electronics of an explosive device that uses radio triggering. Also, electronic memory of explosive device may be reset or changed thereby disabling the operations without necessarily causing physical damage to the device. In either case, the explosive device may be rendered inoperable.

In another embodiment, the electric field is generated using a Tesla coil. Other exemplary embodiments, however, may include high-voltage generators, such as those developed by a North Star Research Corp. Additionally, such high-voltage generators may be used to supply electric charge to the Tesla coil.

In addition or in the alternative, the strong electric field may create an electrical breakdown in the gas (e.g., air) between the source of the electric field and the explosive device. This breakdown causes electric current to be conducted directly into the device and/or wires connected thereto. This electric current may thereby ignite the explosive material of the device and/or disable the triggering electronics. The electric field may be strong enough to provide an arc of electric current to the device, even if the device is underground. For example, it is well-known that electric current conducted to ground (e.g., earth ground) dissipates within the ground just as lightning dissipates within the ground during a strike. However, a strong enough electric field may create a dielectric breakdown of the air that arcs to ground and penetrates the surface of the ground to some variable depth. This ground penetrating electric current may flow to the explosive device and ignite the explosive material therein. Again, embodiments may include using Tesla coils and/or high-voltage generators such as those described hereinabove to generate the electric field.

In another embodiment, the electromagnetic energy may be created in the microwave range of frequencies. This electromagnetic energy may be used to ignite an explosive device, such as one buried underground. This electromagnetic energy may be received by the device that may heat the explosive's ignition electronics leading to the ignition of the explosive device. For example, the ignition electronics may include a bridgewire, electric fuse, circuitry, power supply, communications, etc. The microwave energy may be propagated through a waveguide instead of broadcast propagation of the energy over a standoff distance. Such directed microwave energy may allow higher radiant intensities to be placed at the explosive device. In another embodiment, electrical energy may be coupled to the explosive device electronics through oscillating magnetic fields. For example, wires attached to the explosive device may inductively receive voltages from the oscillating magnetic flux at causes the explosive device to ignite.

The above-mentioned embodiments may be deployed in a variety of ways. For example, a high-voltage generator may be mounted to a vehicle (e.g., a "wheeled" vehicle, a helicopter, etc.) that travels ahead of a formation (e.g., a single person, a battalion, a group of vehicles, etc.). The vehicle may have one or more arms or "booms" that extend and/or dangle from the vehicle. These booms may include electrodes that are electrically coupled to the high-voltage generator to provide a strong electric and/or magnetic field in the vicinity of an explosive device to thereby ignite the device as described hereinabove.

Other manners in which the above embodiments may be deployed may include, for example, a "double headed" Tesla coil coupled to a high-voltage generator. The Tesla coil may step up the voltage from the high-voltage generator through known means of inductance to create strong electric fields in the vicinity of an explosive device. In one embodiment, the double headed Tesla coil oscillates voltage of the two Tesla coil heads between a high positive voltage and a high negative voltage. The strong electric field of each Tesla coil head and the voltage oscillation thereof may produce substantial electric effects which may enhance ignition of an explosive device.

The double headed Tesla coil embodiment may include collapsible/expandable components which enhance shipping abilities. For example, "arms" in the inductive transformer windings of the double headed Tesla coil may be collapsed into smaller components for shipment and expanded into larger components during deployment. Once an explosive device is ignited, electrodes and/or Tesla coils coupled to the high-voltage generator may be destroyed because of the close proximity to the ignition. In one embodiment, the electrodes and/or the Tesla coils are configured of inexpensive materials, such as metal foils. Additionally, the electrodes and/or the Tesla coils may be configured in such a way as to allow for rapid deployment. For example, once an electrode is destroyed by ignition of the explosive device, the electrode may be rapidly connected to the high-voltage generator through preconfigured couplings. Similarly, the Tesla coil may be inexpensively designed for rapid replacement in the event of damage during an IED initiation. Such embodiments may prove to be advantageous because, among other reasons, the increasing frequency of IED attacks may make it highly desirable to quickly replace and install new electrodes.

As used herein, a probe generally refers to a device used to disable an explosive device. For example, a probe may employ electromagnetic radiation and/or electrical discharge to ignite an explosive device or disable triggering mechanisms thereof.

In one embodiment of the invention, a system used to ignite an explosive includes: a generator that generates transferable energy; one or more electrodes that transfer the energy to the explosive via an electric discharge, wherein the energy is used to ignite the explosive; and a vehicle that transports the generator and the electrode, wherein the vehicle comprises a boom that distally positions the one or more electrodes from the generator. Examples of such an explosive may include a land mine, an improvised explosive device, and a combustible material.

The transferable energy may be time varying energy, such as Alternating Current electric energy. For example, the generator may be a high-voltage generator configured for generating between about 12 and 16 kilovolts. The system may also include a Tesla coil configured between the generator and the one or more electrodes for providing the transferable energy from the generator to the one or more electrodes.

The one or more electrodes may be distally positioned from the explosive. Additionally, the one or more electrodes may discharge through a substantially constant point. Alternatively, or in addition to, at least one of the one or more electrodes may include a surface that is substantially horizontal, wherein the surface discharges at one or more points on the surface. The vehicle may include armor to inhibit damage to the vehicle when the explosive ignites. The vehicle may be remotely piloted or piloted by a person.

In another embodiment of the invention, a system used to ignite an explosive includes: a generator that generates transferable energy; and a waveguide that directionally transmits the energy to the explosive, wherein the energy is used to ignite the explosive; and a vehicle that transports the generator and the waveguide, wherein the vehicle comprises a boom that distally positions the waveguide from the generator. The waveguide may be distally positioned from the explosive. The transferable energy may include time varying energy, such as microwave radio frequency energy.

In another embodiment of the invention, a system used to ignite an explosive includes: a generator that provides electric current through a conductor; a means for providing an energy field in communication with the generator, wherein the energy field is used to ignite the explosive; and a vehicle that transports the generator and the means for providing an energy field, wherein the vehicle comprises a boom that distally positions the means for providing an energy field from the generator. The energy field may be an electric field and/or a magnetic field.

In another embodiment invention, a system used to ignite an explosive includes: a generator that provides electric current through a conductor; a means for providing an electric field in communication with the generator, wherein the electric field is used to ignite the explosive; and a vehicle that transports the generator and the means for providing an electric field, wherein the vehicle comprises a boom that distally positions the means for providing an electric field from the generator.

In another embodiment invention, a system used to ignite an explosive includes: a voltage generator; a transformer electrically coupled to the voltage generator and configured for increasing the voltage therefrom; a discharge unit configured using increased voltage to ignite the explosive; and a vehicle that transports the voltage generator, the transformer, and the discharge unit, wherein the vehicle comprises a boom that distally positions the discharge unit from the voltage generator.

The discharge unit may be further configured for generating an arc of electric current from the increased voltage to the explosive to thereby ignite the explosive. The discharge unit may also be further configured for generating an electric field to induce electric current with the explosive from the increased voltage to thereby ignite the explosive. The discharge unit may include a Tesla coil. The discharge unit may also be expandable.

In one embodiment of the invention, a system used to ignite an explosive includes: a generator that generates transferable energy; and an electrode that transfers the energy to the explosive via an electric discharge, wherein the energy is used to ignite the explosive.

In another embodiment of the invention, a system used to ignite an explosive includes: a generator configured for generating transferable energy; and a waveguide configured for transmitting the energy to the explosive, wherein the energy is used to ignite the explosive.

In another embodiment of the invention, a system used to ignite an explosive includes: a generator that provides electric current through a conductor; and a means for providing an energy field in communication with the generator, wherein the energy field is used to ignite the explosive.

In another embodiment of the invention, a system used to ignite an explosive includes: a generator that provides electric current through a conductor; and a means for providing an electric field in communication with the generator, wherein the electric field is used to ignite the explosive.

In another embodiment of the invention, a system used to ignite an explosive includes: a voltage generator; a transformer electrically coupled to the voltage generator and configured for increasing the voltage therefrom; and a discharge unit configured using increased voltage to ignite the explosive. The discharge unit may be further configured for generating an arc of electric current from the increased voltage to the explosive to thereby ignite the explosive. Additionally, the discharge unit may be further configured for generating an electric field to induce electric current with the explosive from the increased voltage to thereby ignite the explosive.

DETAILED DESCRIPTION OF THE DRAWINGS

Figure 1:
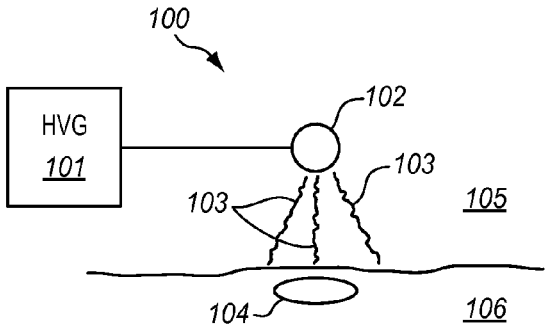
FIG. 1 illustrates a system for igniting an explosive device by conducting (e.g., "arcing" or "discharging") electric current to the device, in one exemplary embodiment of the invention.

While the invention is susceptible to various modifications and alternative forms, specific embodiments thereof have been shown by way of example in the drawings and are herein described in detail. It should be understood, however, that it is not intended to limit the invention to the particular form disclosed, but rather, the invention is to cover all modifications, equivalents, and alternatives falling within the scope and spirit of the invention as defined by the claims.

FIG. 1 illustrates system 100 for igniting an explosive device 104 by conducting (e.g., "arcing") electric current 103 to the device, in one exemplary embodiment of the invention. The explosive device 104 may be buried in ground 106. For example, an opposing force (e.g., a terrorist, a militant group, and/or a military enemy) may bury an explosive device to covertly create confusion with, damage and/or destroy a peacekeeping force. Examples of such attacks have been seen in Vietnam where landmines were the popular means for covertly attacking United States peacekeeping forces. Other examples include the use of IEDs in postwar Iraq against the United States peacekeeping forces.

System 100 includes a high-voltage generator 101 (i.e., labeled HVG 101) configured for generating a substantially high-voltage. For example, HVG 101 may be a voltage generator capable of generating voltages of 200 kilovolts or higher. HVG 101 is electrically coupled to electrode 102, which subsequently provides electric current in the form of electric current arcs 103 through region 105 (e.g., a gas such as air) and possibly through ground 106 to explosive device 104. The electric current provided by electrode 102 may cause electric current to flow within explosive device 101. For example, the electric current may flow through wires, housing components, and/or the explosive material itself of explosive device 104. This current flow may directly ignite explosive device 104 without causing damage to units therebehind (e.g., people, vehicles, other equipment, etc.). Alternatively, electric current may be used to disable explosive device 104 by either physically damaging circuitry of the explosive device and/or by disabling processing features of the device (e.g., by scrambling or deleting computer memory).

In one embodiment of the invention, high-voltage generator 101 includes a Tesla coil configured for delivering the electrical energy. In such an embodiment, the Tesla coil may be configured with elements that provide means for discharging electrical energy from the Tesla coil. For example, a device such as a Tesla coil can obtain very high voltages capable of generating electrical discharge via air breakdown over relatively large distances. Conduction paths leading away from a Tesla coil can be enhanced through elements configured on electrode 102, such as ridges or other features that tend to direct the electrical energy in some manner. With a large enough charge delivered to the Tesla coil, the ability of that charge to break down insulative characteristics of region 105 (e.g., air) is increased to create a conduction path to explosive device 104. Those skilled in the art are readily familiar with Tesla coils and their abilities to discharge electrical energy.

Figure 2:
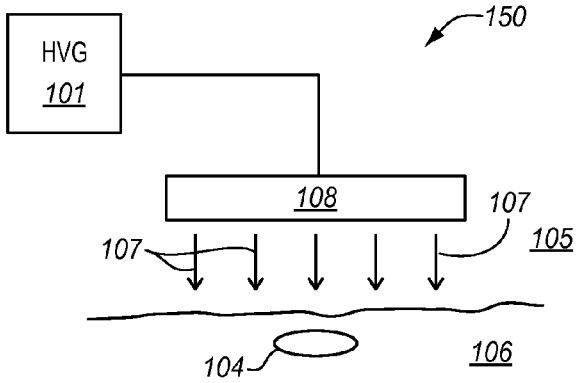
FIG. 2 illustrates another system for igniting an explosive device by generating a strong electric field in the vicinity of the device, in one exemplary embodiment of the invention.

FIG. 2 illustrates another system 150 for igniting an explosive device 104 by generating a strong electric field 107 in the vicinity of the explosive device, in one exemplary embodiment of the invention. System 150 includes HVG 101 to generate a substantially high-voltage as described hereinabove. System 150 also includes an electrode 108 which holds an electric charge from HVG 101. For example, electrode 108 may function as a capacitor plate which creates a strong electric field 107 in the presence of a dielectric, such as region 105. Dielectrics and capacitance are well-known to those skilled in the art.

Electric field 107 may be strong enough to penetrate ground 106 and introduce electric current flow in explosive device 104. For example, the presence of electric field 107 in the vicinity of explosive device 104 may create arcs of electric current between conductible components of explosive device 104 and/or create electric current to flow through the explosive material of the device itself, directly and/or inductively. The electric current may be sufficient to ignite the explosive material of explosive device 107. Moreover, the heat generated by the electric field may be sufficient to ignite explosive device 107. In one embodiment, electric field 107 is an alternating or time-varying electric field used to provide sustained heating of the explosive device 107. For example, the electric current provided to electrode 108 may be alternating electric current ("AC") that is used to generate a corresponding alternating electric field with electrode 108. Accordingly, HVG 101 maybe a high voltage AC generator.

Figure 3:
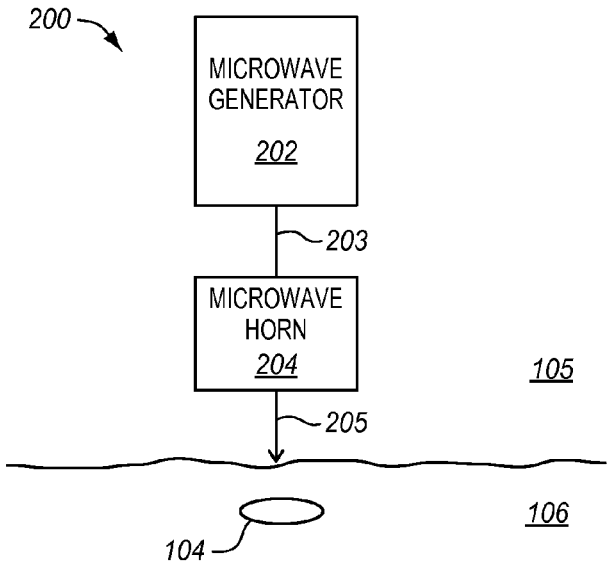
FIG. 3 illustrates yet another system for igniting an explosive device by propagating electromagnetic energy through the air, in one exemplary embodiment of the invention.

FIG. 3 illustrates yet another system 200 for igniting an explosive device 104 by propagating electromagnetic energy 205 through region 105, in one exemplary embodiment of the invention. In this embodiment, system 200 includes a microwave generator 202 configured for generating electromagnetic energy in the microwave frequency region. System 200 includes a waveguide 203 for transmitting the microwave energy over a suitable standoff distance to microwave horn 204. Microwave horn 204 transmits the microwave energy over a relatively short distance to explosive device 104. The electromagnetic energy 205 may be sufficient to penetrate ground 106 and propagate directly to explosive device 104. Electromagnetic energy may directly ignite explosive device 104 through the deposition of electrical energy to the device.

Alternatively, or in addition to, electromagnetic energy may indirectly ignite the explosive device 104 through heat generation or through the induction of currents within the device. For example, as electromagnetic energy 205 radiates, dielectric losses often translate into the generation of heat. The generated heat may be sufficient to ignite explosive device 104. Those skilled in the art should readily recognize that electromagnetic energy of other frequency ranges may be suitable for explosive device ignition.

Figure 4:
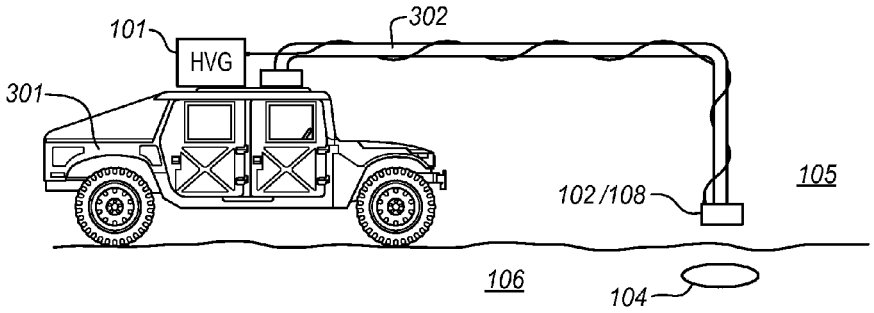
FIG. 4 illustrates a ground vehicle operable with an explosive device ignition system, in one exemplary embodiment of the invention.

FIG. 4 illustrates a ground vehicle 301 operable with an explosive device ignition system, such as systems 100 and 150 shown and described hereinabove, in one exemplary embodiment of the invention. In this embodiment, ground vehicle 301 includes a boom 302 which operates as an arm to support electrode 102/108. Electrode 102/108 is electrically coupled to HVG 101 to deliver electric current to explosive device 104 and thereby ignite the device in accordance with the aspects and features of the invention as described hereinabove. HVG 101 may be carried on ground vehicle 301 or by another vehicle. Ground vehicle 301 may be man-piloted or piloted via remote control. Those skilled in the art are readily familiar with the various manners in which a ground vehicle may be piloted via remote control.

Boom 302 is configured to deliver electric current to explosive device 104 in a manner that distances the ignition from ground vehicle 301. Accordingly, damage is typically only sustained to electrode 102/108. In one embodiment of the invention, electrodes 102/108 are configured of inexpensive materials and are connectable in such a way as to allow for rapid replacement. Those skilled in the art are readily familiar with such materials and connections that maybe used for electrode 102/108.

While one embodiment has been shown and described, those skilled in the art should readily recognize that the invention is not intended to be limited to the illustrated embodiment. For example, ground vehicle 301 may be configured in other ways which allow for HVG 101 to deliver electric current to electrode 102/108 from a distance to substantially prevent damage to ground vehicle 301 upon ignition of explosive device 104. Additionally, the invention should not be limited to the single boom 302 and/or electrodes 102/108. Other embodiments may include a plurality of electrodes 102/108 attached to one or more booms 302. For example, a plurality of electrodes 102/108 may be configured in a rake configuration which allows for electrostatic discharge to explosive device 104 from one or more discharge points.

Figure 5:
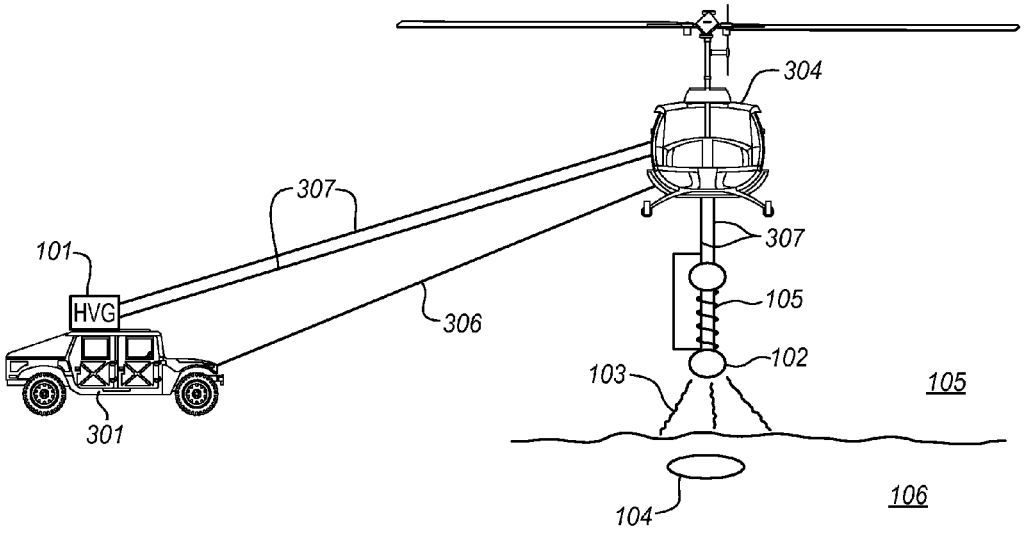
FIG. 5 illustrates an air vehicle operable with an explosive device ignition system, in one exemplary embodiment of the invention.

FIG. 5 illustrates an air vehicle 304 (e.g., a helicopter) operable with an explosive device ignition system such as those described hereinabove, In one embodiment of the invention. For example, air vehicle 304 may be configured to "dangle" electrode 102 to conduct (e.g., arc) electric current 103 to explosive device 104 within ground 106 and thereby ignite explosive device 104. Electrode 102 may be dangled at a distance from the air vehicle 304 which would substantially reduce danger from ignition of explosive device 104. As with ground vehicle 301, air vehicle 304 may be man-piloted or piloted via remote control.

In this embodiment, electrode 102 may include a Tesla coil that is coupled to HVG 101. Within this coupling, voltage from HVG 101 maybe "stepped up" to a higher voltage than that generated by HVG 101 through the use of a Tesla coil 305. Tesla Coil 305 has a primary side coupled to HVG 101 which induces electric current within a secondary side 305. The secondary side of Tesla Coil 305 in this embodiment may be coupled to electrode 102 such that the electric current induced by the primary side of the Tesla Coil 305 may be discharged to explosive device 104 in accordance with the embodiments shown and described hereinabove. Tesla Coils and their respective configurations are well-known to those skilled in the art and their implementations are typically a matter of design choice. Air vehicle 304 may include a cable 306 that is used as a tether between the air vehicle and nearby ground vehicle 301. For example, HVG 101 may be configured with ground vehicle 301 such that high-voltage generation is not performed upon air vehicle 304; rather it is generated upon ground vehicle 301 and transferred to electrode 102 via high-voltage cables 307. Such a configuration may reduce the weight of an aircraft. Alternatively, the tethered connection between the ground vehicle 301 and the air vehicle 304 may include power and control for the air vehicle as well as the electrical energy from the HVG 101. The ground vehicle 301 may or may not be manned, typically depending on the length of the tethered connection.

Figure 6:
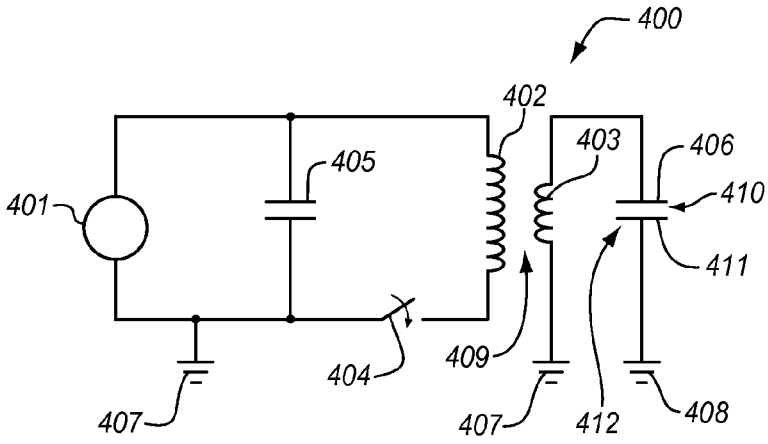
FIG. 6 illustrates a circuit diagram of an explosive device detonation system, in one exemplary embodiment of the invention.

FIG. 6 illustrates a circuit diagram of an explosive device ignition system 400, in one exemplary embodiment of the invention. In this embodiment, explosive device ignition system 400 includes a high-voltage source 401 coupled in parallel with high voltage capacitor 405. High-voltage capacitor 405 is charged by source 401 and is coupled to primary side 402 of transformer 409 via switch 404. In one embodiment of the invention, switch 404 is a high-voltage thyratron capable of conducting current to primary side 402 until capacitor 405 is charge-depleted, at which time the switch 404 opens. Those skilled in the art are readily familiar with thyratrons. The invention, however, is not intended to be limited to thyratrons. Rather, other switches may be used such as those particularly well suited for high voltage coupling (e.g., thyristors).

Primary side 402, secondary side 403 and capacitor plate 406 of capacitor 412 may be representative of a Tesla coil. For example, a Tesla Coil is a resonantly coupled device. A charge on capacitor 412 may provide an alternating voltage (e.g., AC voltage). As the coil "rings up", eventually the voltage may exceed the voltage required to discharge through air. The discharge may actually grow over several oscillations of the coil, until it reaches ground and delivers energy in the coupled Tesla Coil system. In this regard, capacitor 412 may be representative of the electrode(s), breakdown region and explosive device described hereinabove. As electric current is conducted through primary side 402, electric current is induced through secondary side 403. Current induced in secondary side 403 is used to charge capacitor 412. Dielectric region 410 may be representative of region 105 and capacitor plate 411 may be representative of explosive device 104, as described hereinabove. The electric current short-circuiting through capacitor 412 may be sufficient to ignite an explosive device 104.

While the invention is generally directed towards Tesla coils, those skilled in the art should readily recognize that other embodiments may include other high voltage devices. Accordingly, the invention is not intended be limited to a particular type of high voltage delivery system.

Figure 7:
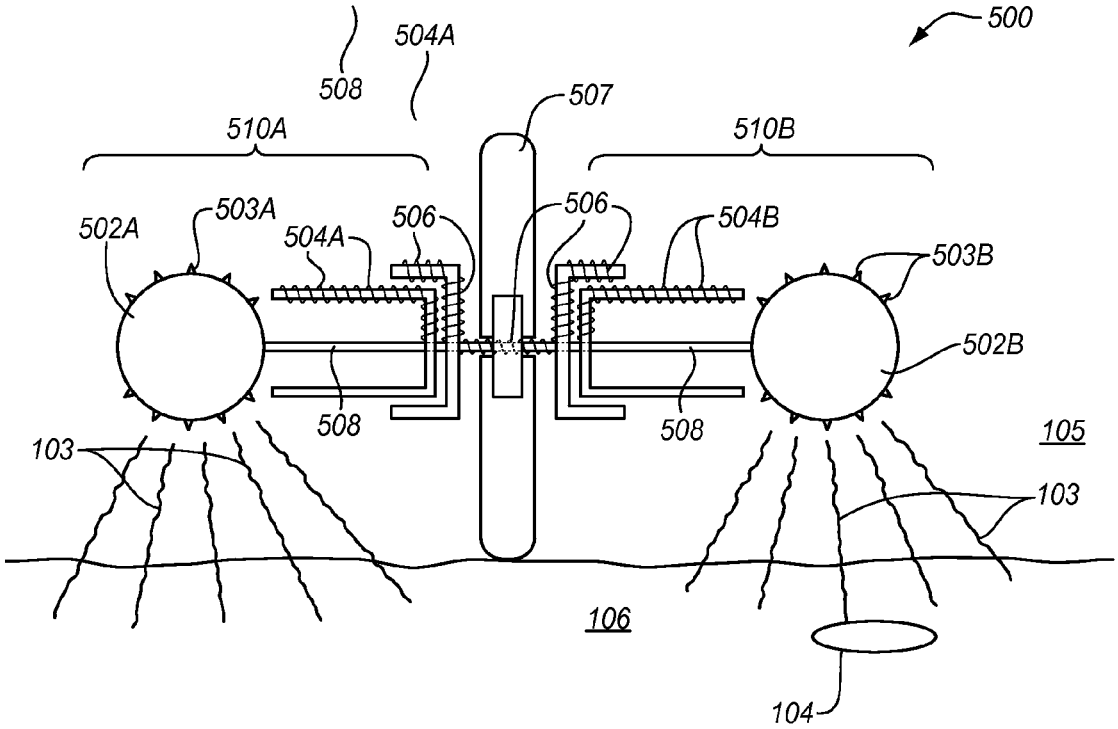
FIG. 7 illustrates a ground vehicle operable with a "double headed" Tesla coil used as an explosive device ignition system, in one exemplary embodiment of the invention.

FIG. 7 illustrates another ground vehicle 500 operable with a "double headed" Tesla coil used as an explosive device ignition system, in one exemplary embodiment of the invention. For example, one "head" 510*a* of the Tesla coil may include a charge holding electrode 502*a* that receives charge from a secondary side 504*a*. The secondary side 504*a* may have current induced therein by primary side 506. As such, secondary side 504*a* and primary side 506 may form a transformer which receives voltage from a high-voltage source and steps up that voltage to deliver charge to charge holding electrode 502*a* (e.g., a toroid). The second head 510*b* may be configured in a similar manner.

In one embodiment of the invention, primary side 506 is a one or more windings that induces electric current in the windings of secondary sides 504*a* and 504*b*. Primary side 506 may induce electric current in an Alternating Current ("AC") fashion. In this embodiment, while head 510*a* experiences a charge of positive high-voltage, head 510*b* experiences a charge of negative high-voltage. AC may enhance electrical ignition of explosive device 104 through the large swings, or oscillating surges, of current through explosive device 104.

Electrical charge builds on the charge holding electrodes 502*a* and 502*b* which discharges as arcs 103 of electric current. To enhance discharge, the charge holding electrodes 502*a* and 502*b* may include discharge elements 503*a* and 503*b*, respectively. For example, discharge elements 503*a* and 503*b* may be elements, such as spikes, ridges, or other protrusions on charge holding electrodes 502*a* and 502*b*. These features of charge holding electrodes 502*a* and 502*b* extend from the charge holding electrode's surface so as to focus electric charge to a point and thereby enhance electrostatic discharge. These elements may be spaced apart in a pattern and/or randomly configured randomly so that such that they reduce the distance between ground 106 and charge holding electrodes 502*a* and 502*b* in some periodic manner (e.g., as each charge holding electrode rotates). The charge on the charge holding electrodes 502*a* and 502*b* may be such that arcs 103 of electric current are strong enough to penetrate ground 106 and conduct current to and/or through explosive device 104. Those skilled in the art are familiar with Tesla coils. One example of a Tesla coil is shown and described below in FIG. 16.

The ground vehicle 500 used to deploy such a double headed Tesla coil may include wheel 507 and axle 508. Wheel 507 and axle 508 may be used to propel ground vehicle 500. Additionally, wheel 507 and axle 508 may be used to rotate charge holding electrodes 502*a* and 502*b* as wheel 507 turns. For example, when electrical discharge to ground does not sufficiently connect to the explosive device, mechanical variation in the electrode may disrupt the electrical discharge connection allowing a new discharge to be established at a new location. Such may lead to an improved probability of the discharge connecting to the explosive device.

The size of wheel 507 may be taken into consideration when designing a double headed Tesla coil. For example, design considerations may include the distance in which each charge holding electrode 502*a* and 502*b* is suspended above ground 106. The distance between a charge holding electrode 502*a* and 502*b* and ground 106 may determine the amount of charge supplied to each charge holding electrode 502*a* and 502*b* and/or the size of each charge holding electrode 502. Greater distances between a charge holding electrode 502*a* and 502*b* and ground 106 may require more charge to be delivered to each charge holding electrode. Additionally, the size of wheel 507 may dictate the size of each charge holding electrode 502*a* and 502*b* since the size of wheel 507 determines axial placement of the charge holding electrodes.

Figure 8:
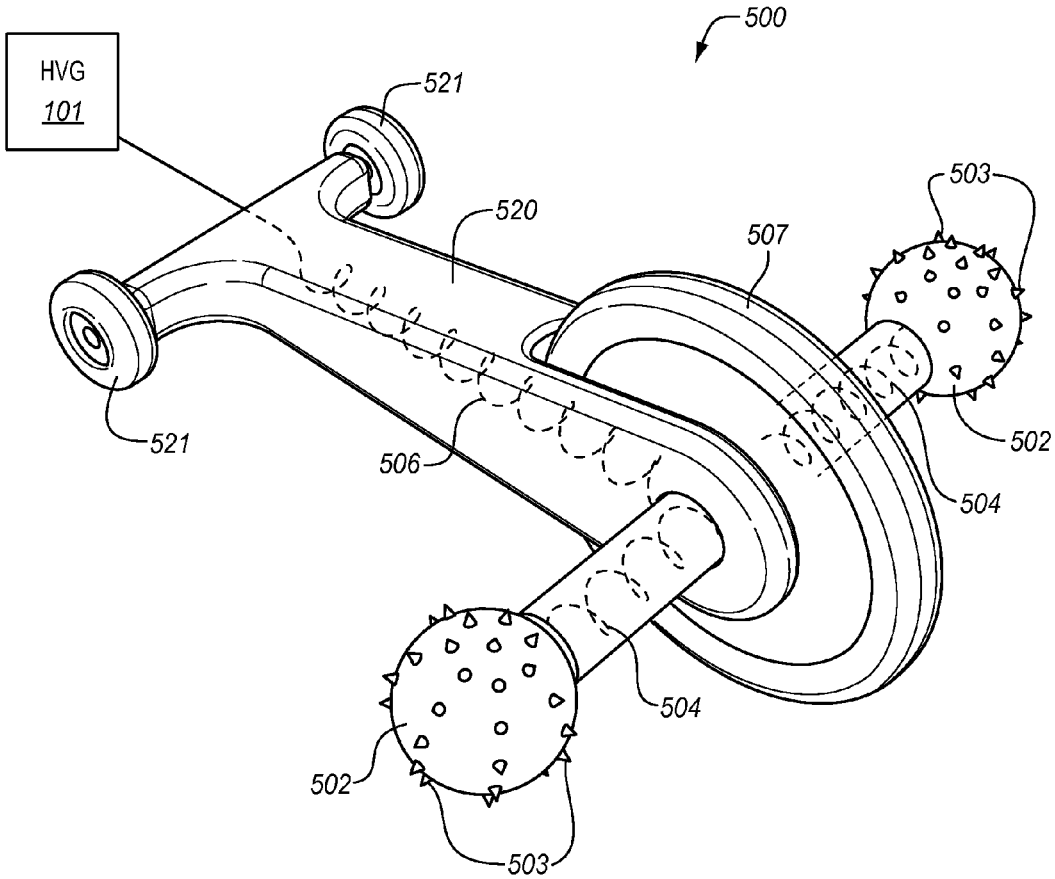
FIG. 8 illustrates a perspective view of the ground vehicle of FIG. 7.

FIG. 8 illustrates a perspective view of the ground vehicle 500 of FIG. 7. FIG. 8 shows how the double headed Tesla coil may be configured with a "cart-like" body 520 supported and movable via wheel 507 and wheels 521. HVG 101 is used to generate voltage and conduct that voltage to the transformer that is primary side 506 and secondary side 504. In one embodiment, HVG 101 is mounted to a powered vehicle that follows behind ground vehicle 500. For example, components of ground vehicle 500 may be included partly or entirely of lesser expensive materials such that when an explosive device 104 is ignited, the ground vehicle 500 may be rapidly replaced and/or repaired. Additionally, portions of ground vehicle 500, such as the secondary sides 504*a* and 504*b* and charge holding electrodes 502*a* and 502*b*, may be collapsible for compact storage. High-voltage generators, such as HVG 101, are typically more complex and/or expensive devices. By placing HVG 101 behind ground vehicle 500, damage or destruction to HVG 101 may be substantially prevented.

One trade-off between the size of the electric field generated by the electrodes and the magnitude of the field at some distance away from the electrode may exist. For example, it may be preferable for the radius of a spherical electrode to be proportional to or nearly the same as the distance from the ground. Also, time dependent electric fields may yield repeated, periodic discharges and/or heat an explosive device.

In one embodiment, a Marx generator could be used to charge multiple capacitors in series and then place them together in parallel to achieve higher voltages. Additionally, other electrical circuitry could be used to provide more electrical energy once an electrical discharge is established and sensed. Alternatively, ground vehicle 500 may be configured with a microwave feed that is placed in proximity to ground 106 such that microwave energy is transmitted by a waveguide to remotely ignite explosive devices.

Other embodiments may include a vehicle that tows electrodes/microwave feeds (e.g., either in front of or behind the vehicle) to ignite the explosive device. Such vehicles may be configured with booms or arms that are pivotable or otherwise movable relative to the vehicle. Further, a control mechanism may be configured with the remote vehicle to change the position of the boom. Sufficient standoff distances may vary depending on many factors such as the strength of the explosive device, whether or not it is buried in the ground, the depth to which it is buried, the protection on the humans or equipment, and so forth. Examples as such embodiments are illustrated below in FIGS. 9 through 17.

Figure 9:
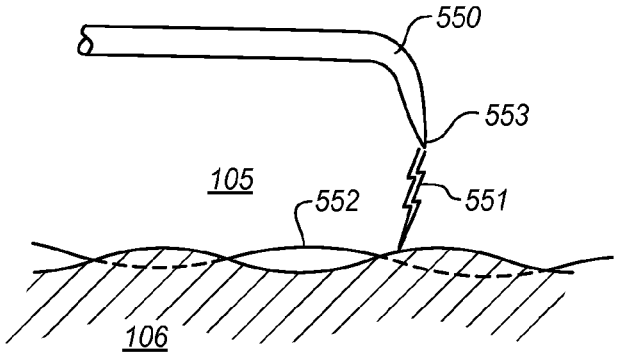
FIG. 9 illustrates a probe for providing electrical discharge to an explosive device or a wire thereof, in one exemplary embodiment of the invention.

Advantages of a double headed Tesla coil may include better flux coupling (i.e., more efficient coupling from primary side 506 to secondary sides 504*a* and 504*b*). Additionally, the double headed Tesla coil increases coverage area by providing for provides for electrical energy discharges on both sides of ground vehicle 500. FIG. 9 illustrates probe 550 for providing electrical discharge 551 to an explosive device or a wire 552 thereof, in one exemplary embodiment of the invention. For example, probe 550 may be electrically coupled to a high-voltage generation device, such as those described hereinabove, to electrically discharge through region 105 (e.g., air) to a component of an explosive device (e.g., wire 552). Probe 550 may be configured to initiate electrical discharge 551 such that electrical breakdown of region 105 will occur and conduct to wire 552 to ignite an explosive device coupled thereto.

Such electrical breakdown of region 105 may occur when electric potential between probe 550 and wire 552 reaches a certain level. For example, electric breakdown of air may depend on, among other things, particulates in the air and/or distance between probe 550 and wire 552. Once the electric potential reaches a level high enough to overcome, for example, the insulative features of the air, electrical discharge 551 may conduct to wire 552.

In some instances, electrical discharge 551 may be strong enough to penetrate ground 106 and conduct directly to wire 552. Such electrical conduction may also be the result of inductive influences upon wire 552 as electrical discharge 551 penetrates ground 106. Those skilled in the art should readily recognize, however, that the invention is not intended to be limited to a particular type of conduction within wire 552 and/or an explosive device coupled thereto.

Figure 13:
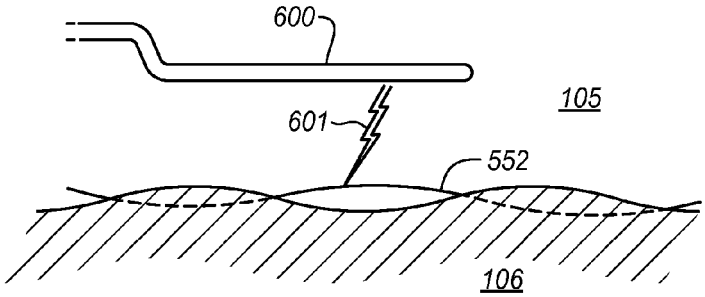
FIG. 13 illustrates another probe for providing electrical discharge to an explosive device, in one exemplary embodiment of the invention.

Probe 550 may be useful in providing electrical energy discharges to relatively small areas. For example, tip 553 of probe 550 may provide certain features that preferentially direct discharge of the electrical energy. The invention, however, is not intended to be limited to the embodiment shown and described herein. For example, FIG. 13 illustrates probe 600 having certain features that allow for discharge of electrical energy where distance between probe 600 and an object (e.g., an explosive device and/or circuitry thereof) may vary.

Figure 10:
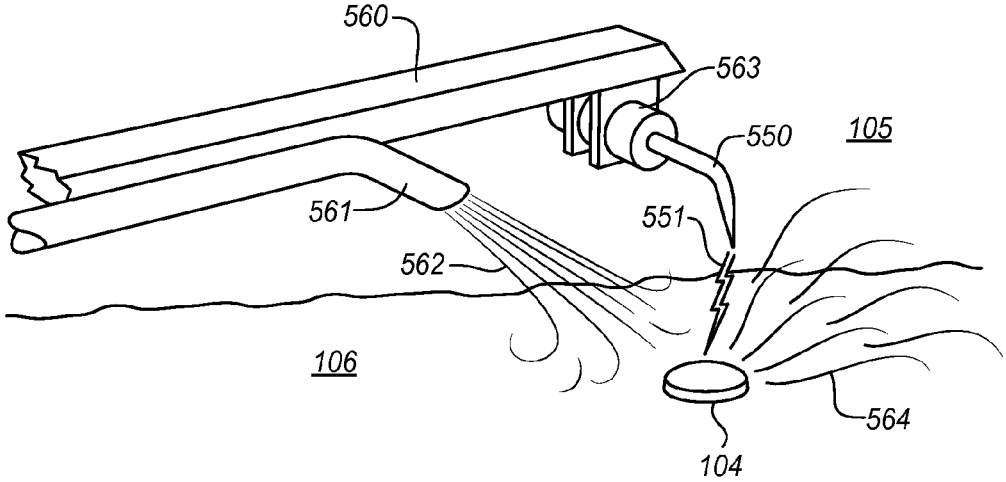
FIG. 10 illustrates a probe with a blower for providing electrical discharge to an explosive device, in one exemplary embodiment of the invention.
Figure 11:
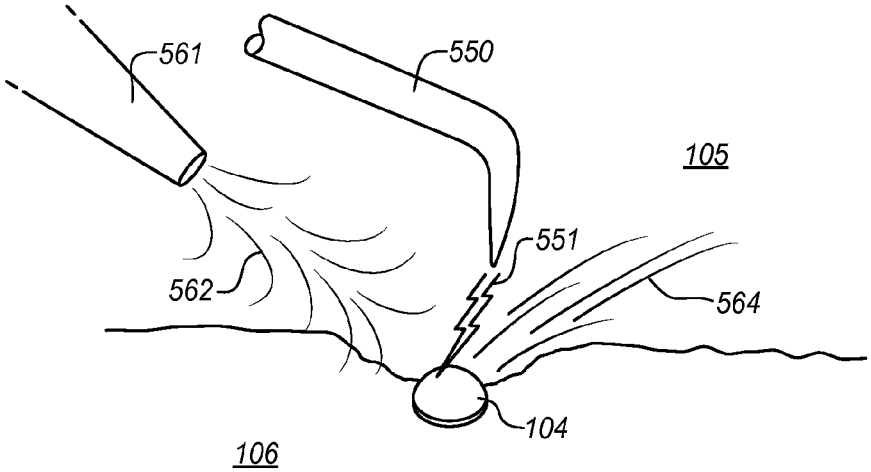
FIG. 11 illustrates a closeup view of the probe and blower of FIG. 10.

FIG. 10 illustrates probe 550 with blower 561 for providing electrical discharge 551 to explosive device 104, in one exemplary embodiment of the invention. In this embodiment, probe 550 is configured with a boom 560 to electrically discharge to explosive device 104 from a distance that offers relative safety from an explosion thereof.

Blower 561 may blow air 562 to at least partially unearthed explosive device 104. For example, air 562 blown across ground 106 at a sufficient pressure may cause ground 106 to "stir" and disperse from a buried explosive device, such as a land mine, an IED, etc. Accordingly, explosive device 104 may be revealed and conduction of electrical discharge 551 to the explosive device may be improved. A close-up view of such as exemplarily illustrated in FIG. 11.

Additionally, particulates 564 caused by the disruption of ground 106 may also improve conduction of electrical discharge 551. For example, ground 106 may include materials that are conductive. Furthermore, particulates in the air may enhance local electric field effects that reduce breakdown thresholds. Accordingly, particulates 564 may cause a conductive path between probe 550 and explosive device 104. The conduction of electrical discharge 551 may thereby directly ignite explosive device 104. Also configured with probe 550 is Tesla coil 563. Tesla coil 563 provides electrical energy to probe 550 such that electrical discharge 551 may be generated. Tesla coil 563 may be configured in a variety ways known to those skilled in the art, such as those described hereinabove.

Figure 12:
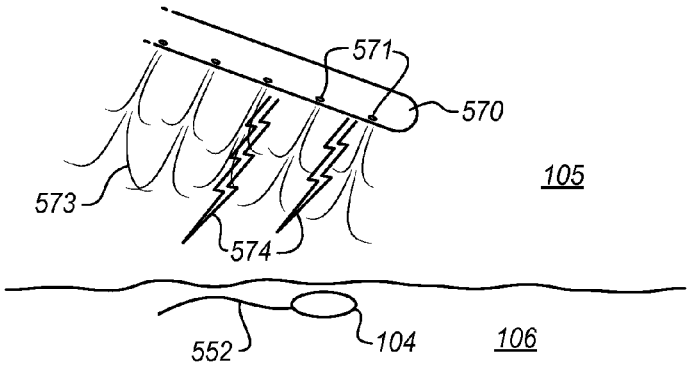
FIG. 12 illustrates a probe/blower for providing electrical discharge to an explosive device, in one exemplary embodiment of the invention.

FIG. 12 illustrates probe/blower 570 for providing electrical discharge 574 to explosive device 104, in one exemplary embodiment of the invention. In this embodiment, probe/blower 570 configures blower functionality, such as that of blower 561 of FIGS. 10 and 11, with probe functionality, such as that of probe 550. For example, probe/blower 570 may be a vented structure with holes 570 through which gas (e.g., air) 573 is forced. Additionally, probe/blower 570 may be configured from material that is conducive for maintaining electrical energy (e.g., copper, aluminum, or other conductive materials) such that the probe/blower may electrically discharge to explosive device 104 or wire 552 connected thereto.

The gas may also include particulates or aerosols to enhance the electrical discharge, for example, by reducing the voltage required for breakdown through effects such as local electrical field enhancement near the particulates. Particulates that are relatively easy to ionize may be selected to provide electrons to enhance discharge development. For example, an electric field within a particle may be reduced by charge movement or charge polarization. Charge displacement may enhance an electric field outside the particle. Local electric field enhancement around charged particles may enhance ionization and cascading electrical discharges at lower macroscopic electric field strengths.

The gas may be something other than air and selected to enhance the discharge. For example a gas with a relatively low ionization potential or having less electronegative components may allow for discharges over longer distances and/or for longer times while typically requiring less energy. One example of a gas that may be used already having particulates through the exhaust gas from an internal combustion engine, such as that commonly found in various vehicles. Moreover, electric discharge may be enhanced by heating the blown gas such that the gas and air obtains a lower density. For example, the breakdown potential of a gas is typically lowered at reduced densities, as is known to those skilled in the art.

FIG. 13 illustrates probe 600 configured for providing electrical discharge 601 to an explosive device (e.g., explosive device 104 described hereinabove) or a wire connected thereto (e.g., wire 552), in one exemplary embodiment of the invention. Probe 600 may be configured as a plate having an electrode edge 602 that advantageously directs electrical discharge 601 through region 105 towards an explosive device and/or an electrical discharge of varying distance between probe 600 and the explosive device. For example, probe 600 may discharge electrical energy to objects that protrude from ground 106. Since the electric field strength is not focused to a particular point, such as probe 550 of FIG. 9, electrical energy may preferentially discharge from probe 600 to an object at the shortest distance between the object and the probe. This type of discharge may allow for probe 600 to "find" the object and discharge thereto.

Figure 14:
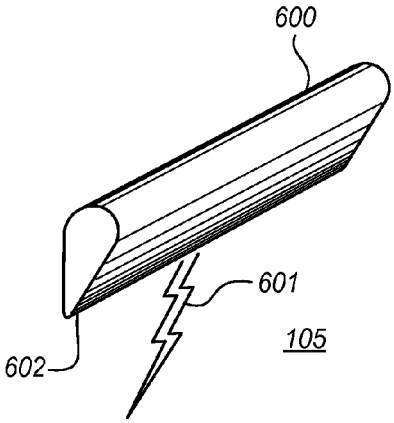
FIG. 14 illustrates a perspective view of the probe of FIG. 13.
Figure 15:
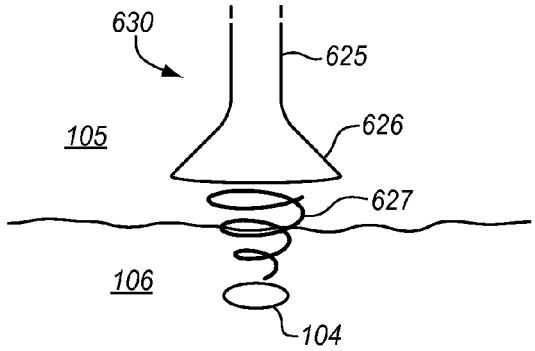
FIG. 15 illustrates a probe for directing electromagnetic energy to an explosive device, in one exemplary embodiment of the invention.

As described hereinabove, electrical discharge 601 may cause heating and/or electric current to flow through an explosive device and/or circuitry thereof. Such electric current may ignite the explosive device and/or disable its triggering mechanisms. FIG. 14 illustrates a perspective view of the probe of FIG. 13. FIG. 15 illustrates probe 630 for directing electromagnetic energy 647 to explosive device 104, in one exemplary embodiment of the invention. In this embodiment, probe 630 is configured with waveguide 625 to receive electromagnetic radiation from, for example, a microwave generator. Waveguide 625 may be configured with horn antenna 626 which advantageously directs electromagnetic energy 627 through region 105, ground 106 and to explosive device 104. Electromagnetic energy 627 in the microwave region or e.g. other radio frequency regions may advantageously penetrate through nonconductive material of ground 106. As such, electromagnetic energy 627 may, as described hereinabove, cause heating and/or electrical current to flow in explosive device 104. Such heating and/or electrical conduction may ignite explosive device 104.

While FIGS. 9 through 15 illustrate and describe a plurality of embodiments that may be used to ignite explosive device 104 and/or disable electronics thereof, those skilled in the art should readily recognize the invention is not intended to be limited to the embodiments herein. Other probes may be configured to provide ignition and/or disablement of explosive device 104 that fall within the scope and spirit of the invention.

Figure 16:
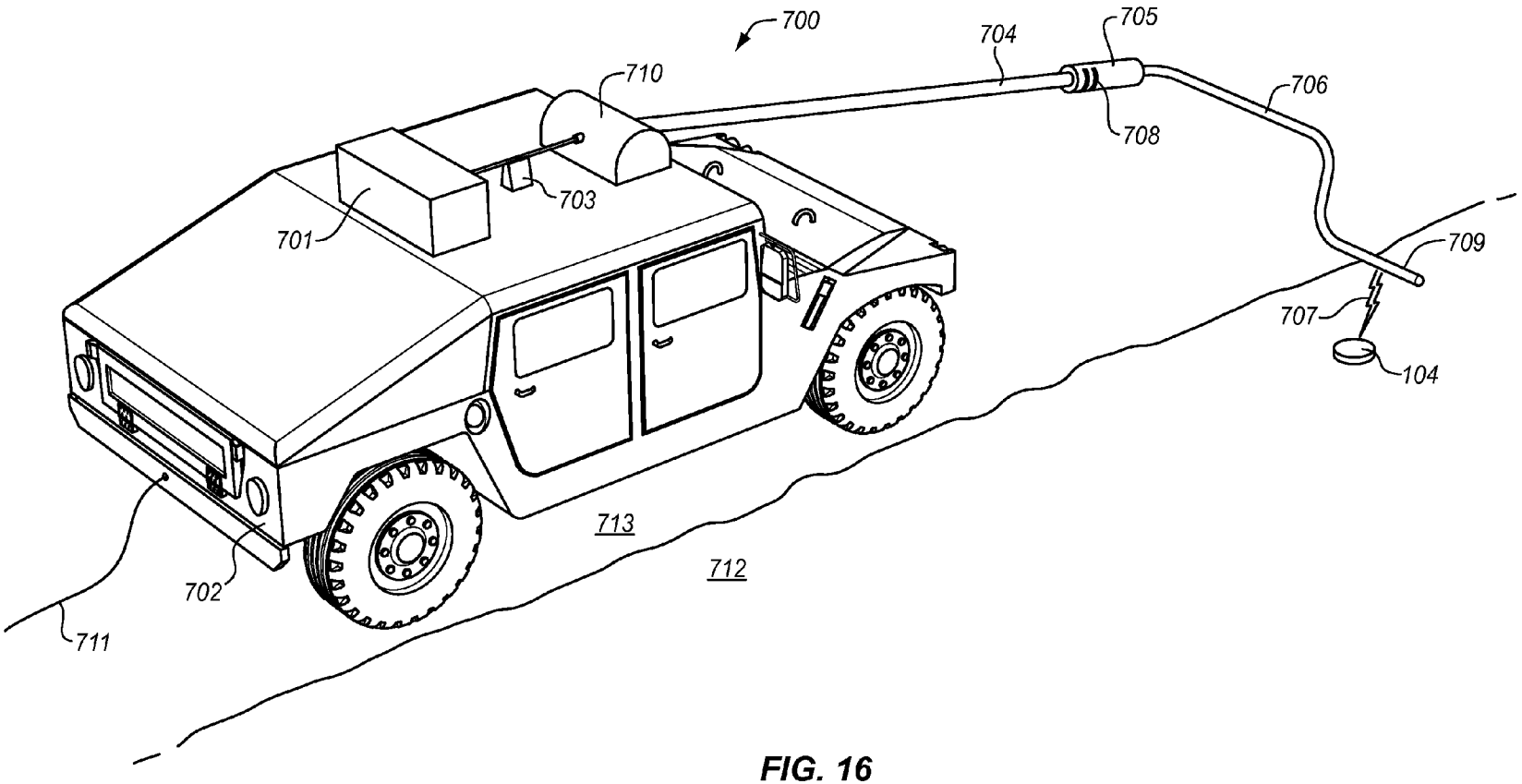
FIG. 16 illustrates a vehicle carrying a probe for providing an electrical discharge to an explosive device, in one exemplary embodiment of the invention.

FIG. 16 illustrates vehicle 702 carrying probe 706 for providing electrical discharge 707 to explosive device 104, in one exemplary embodiment of the invention. In this embodiment, probe 706 receives electrical energy from primary side 708 of Tesla coil 705 through coupling to secondary side 711 of the Tesla coil. The electrical energy is generated and controlled by high-voltage generator 701 and thyratron 703. In one embodiment, the electrical energy provided to probe 706 is between about 12 and 16 kilovolts. High-voltage generator 701 and thyratron 703 are configured upon vehicle 702 and distally positioned from end 709 of probe 706. To provide sufficient ground for high-voltage generator 701, a conductive cable 711 may be affixed to vehicle 702 that drags upon the ground 712 and/or road 713. For example, conductive cable 711 may be a chain or metal wire that drags upon ground 712 and/or road 713 behind vehicle 702 as the vehicle moves.

Probe 706 may be affixed to boom 704 so as to position electrical discharge 707 away from vehicle 702. By positioning electrical discharge 707 away from vehicle 702, vehicle 702, high-voltage generator 701 and other components may be located in a safe standoff position during ignition of explosive device 104. Distance of boom 704 may depend on one or more of a plurality of factors. Such factors may include, for example, location of explosive device 104, amount and type of explosive material of explosive device 104.

In one embodiment of the invention, the Tesla coil is a 100 kHz Tesla coil having a primary side 402 constructed of copper tubing having a diameter of about 0.37 inches and wrapped 3 to 4 times around the outer PVC tubing. The spacing between each turn in the primary may be about 0.37 inches. The primary side 402 may be attached to high voltage capacitors having a capacitance of about 0.4 μH. The capacitors may be charged to a voltage between 12 kV and 16 kV before current is switched through primary side 402 (e.g., using a thyratron).

The secondary side 403 may be constructed from polyvinyl chloride ("PVC") tubing having a length of about 36" and a diameter of about 8". About 2464 feet of 0.0253 inch diameter copper wire is wound around the PVC tubing approximately 1176 times over the length of the coil. The secondary side 403 and may be inserted and centered into an outer PVC tubing having an outer diameter of about 13 inches. The outer PVC tubing may be filled with either transformer oil or a gas combination (e.g., SF6) to inhibit discharges. The outer PVC tubing is sealed to retain the fill. The high voltage ends of the secondary side 403 are attached to probe 706. Probe 706 may have a capacitance to ground of about 29.5 pF.

Electrical discharges may be controlled such that subsequent electrical discharges track previous electrical discharges when desired. For example, the electrical energy may be discharged at a particular repetition frequency. The repetition frequency of the discharge may be chosen in such a way as to deposit electrical energy multiple times within a thermal diffusion time of the explosive triggering device (e.g., 200 Hz).

Figure 17:
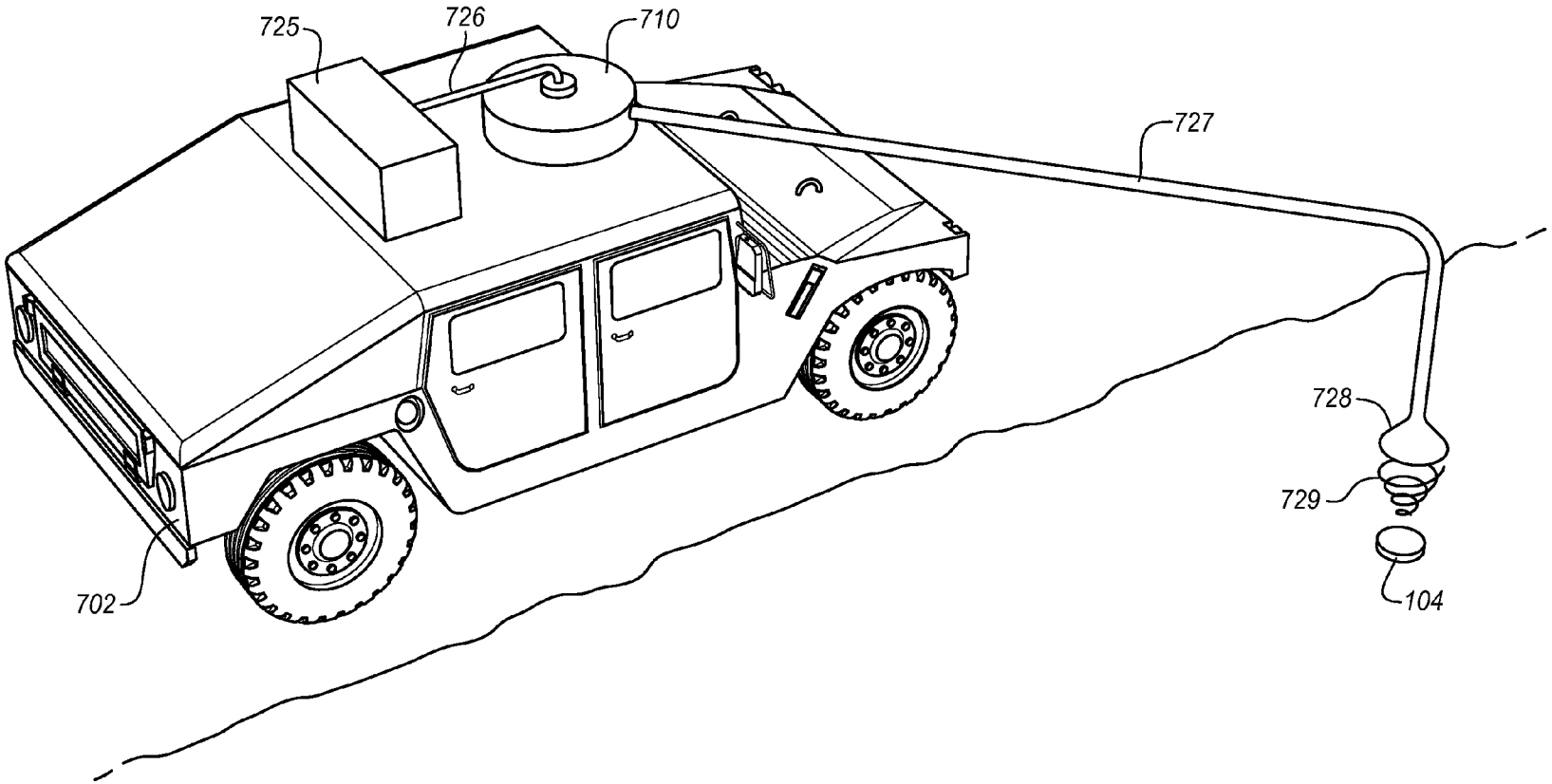
FIG. 17 illustrates a vehicle carrying a probe for directing electromagnetic energy to explosive device, in one exemplary embodiment of the invention.

FIG. 17 illustrates vehicle 702 carrying probe 727 for directing electromagnetic energy 729 to explosive device 104, in one exemplary embodiment of the invention. For example, probe 727 may be a waveguide that directs electromagnetic energy 729 from vehicle 702 to horn antenna 728. Horn antenna 728 directionally radiates electromagnetic energy 729 towards explosive device 104 to ignite the explosive device, as described herein above.

In this embodiment, vehicle 702 is configured with microwave RF generator 725 to generate electromagnetic energy 729 in the microwave or e.g. other radio frequency regions region. Electromagnetic energy 729 is propagated through waveguide 726 to probe 727. Ultimately, electromagnetic energy 729 may be radiated to explosive device 104 via horn antenna 728 to ignite or otherwise disable the explosive device.

As described hereinabove, vehicle 702 may be a pilot and vehicle or a remotely controlled vehicle. Vehicle 702 may also be configured with armor so as to reduce the likelihood of damage to vehicle 702 when explosive device 104 is ignited. Additionally, vehicle 702 may be configured with boom control 710 that controls position of a probe (e.g., probe 706 or probe 727). For example, boom control 710 may be a motorized control unit that moves the probe vertically and/or horizontally to position the probe in the vicinity of explosive device 104. Those skilled in the art are readily familiar with such motorized control units.

While vehicle 702 is configured with a single probe (e.g., probe 706 or probe 747), those skilled in the art should readily recognize that the invention is not intended to be limited to a single probe of the illustrated embodiments. Rather, vehicle 702 may be configured with a plurality of probes. Additionally, each probe may be configured according to one or more of the embodiments described hereinabove to ignite or otherwise disable explosive device 104.

While the invention has been illustrated and described in detail in the drawings and foregoing description, such illustration and description is to be considered as exemplary and not restrictive in character. For example, certain embodiments described hereinabove may be combinable with other described embodiments. Accordingly, it should be understood that only the preferred embodiment and minor variants thereof have been shown and described and that all changes and modifications that come within the spirit of the invention are desired to be protected.

What is claimed is:

1. A system operable to ignite an explosive device, including:

a land vehicle;

a high voltage electrical generator;

an electrode electrically coupled to the high voltage electrical generator and distally positioned from the land vehicle above land, wherein the electrode operates to discharge electrical energy from the high voltage electrical generator to the explosive to ignite the explosive device; and at least one grounding chain electrically coupled to the high voltage electrical generator, wherein the at least one grounding chain is affixed to the land vehicle and in contact with the land to provide a ground potential reference for the high voltage electrical generator.

2. The system of claim 1, wherein the vehicle is electrically isolated from the high voltage generator.

3. The system of claim 1, wherein the electrode has an edge that enhances discharge to the explosive according to the shortest distance between the electrode and the explosive device.

4. The system of claim 1, wherein the land vehicle is armored.

5. The system of claim 1, wherein the electrical energy has a voltage greater than about 10 kV and operates to ignite the buried explosive device.

6. The system of claim 1, wherein the electrical energy has a voltage that operates to form a dielectric breakdown of air between the electrode and the land, and wherein a current of the electrical energy through the dielectric breakdown operates to penetrate the land to ignite the buried explosive device.

7. The system of claim 1, wherein the electrical energy operates to trigger electronics of the explosive to ignite an explosive material therein.

8. The system of claim 7, wherein the buried explosive device is an improvised explosive device.

9. The system of claim 7, wherein the buried explosive device is a landmine.

10. The system of claim 1, further including a coupling mechanism that operates to facilitate rapid replacement of the electrode after being damaged by an ignition of the buried explosive device.

11. The system of claim 1, wherein the electrical energy has a voltage that operates to form an electric field between the buried explosive device and the electrode.

* * * * *